US010516239B2

(12) United States Patent
Loetkemann et al.

(10) Patent No.: US 10,516,239 B2
(45) **Date of Patent: *Dec. 24, 2019**

(54) HOLDING FRAME AND METHOD FOR PRODUCING SAME

(71) Applicant: HARTING ELECTRIC GMBH & CO. KG, Espelkamp (DE)

(72) Inventors: Irina Loetkemann, Espelkamp (DE); Bernard Schlegel, Rahden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 234 days.

This patent is subject to a terminal disclaimer.

(21) Appl. No.: 15/502,488

(22) PCT Filed: Jul. 28, 2015

(86) PCT No.: PCT/EP2015/067221

§ 371 (c)(1),
(2) Date: Feb. 7, 2017

(87) PCT Pub. No.: WO2016/020223

PCT Pub. Date: Feb. 11, 2016

(65) Prior Publication Data

US 2017/0237209 A1 Aug. 17, 2017

(30) Foreign Application Priority Data

Aug. 8, 2014 (DE) ..... 10 2014 215 809

(51) Int. Cl.
*H01R 13/518* (2006.01)
*H01R 13/74* (2006.01)
(Continued)

(52) U.S. Cl.
CPC ..... *H01R 13/74* (2013.01); *H01R 13/514* (2013.01); *H01R 13/516* (2013.01);
(Continued)

(58) Field of Classification Search
CPC ..... H01R 13/74; H01R 43/00; H01R 13/514; H01R 13/518; Y10T 29/49877
See application file for complete search history.

(56) References Cited

U.S. PATENT DOCUMENTS 3,412,368 A 11/1968 Asbridge et al. ..... 339/126
4,975,081 A * 12/1990 Daly ..... H01R 11/11 439/422

(Continued)

FOREIGN PATENT DOCUMENTS

CN 1191400 8/1998 ..... H01R 13/514
CN 1988277 6/2007 ..... H01R 13/518

(Continued)

OTHER PUBLICATIONS

Russian Search Report (w/translation) issued in application No. 2017107180/07, dated Apr. 19, 2018 (4 pgs).

(Continued)

*Primary Examiner* — Sarang Afzali
*Assistant Examiner* — Ruth G Hidalgo-Hernandez
(74) *Attorney, Agent, or Firm* — Hayes Soloway P.C.

(57) ABSTRACT

Provided is a holding frame for holding plug connector modules and for installing in plug connector casings or for screwing onto wall surfaces, wherein the plug connector modules are inserted into the holding frame and a holding arrangement on the plug connector modules cooperate with recesses provided on opposite side parts of the holding frame. Also, to allow simplified and/or less cost-intensive production with additional flexibility regarding the positioning or omission of earthing contacts, without compromising safe handling of the holding frame, one frame half has a projection in at least one fastening section, which protrudes in the direction of the other frame half and which engages with a recess in the fastening section of the other frame half in such a way that any lateral displacement of the side parts is prevented.

7 Claims, 3 Drawing Sheets

(51) Int. Cl.
*H01R 13/516* (2006.01)
*H01R 13/514* (2006.01)
*H01R 43/00* (2006.01)

(52) U.S. Cl.
CPC ..... *H01R 13/518* (2013.01); *H01R 43/00* (2013.01); *Y10T 29/49877* (2015.01)

(56) References Cited

U.S. PATENT DOCUMENTS

| | | | | |
|---|---|---|---|---|
| 6,004,162 | A | 12/1999 | Harting et al. | 439/701 |
| 7,086,880 | B2 | 8/2006 | Uchida | 439/141 |
| 7,316,591 | B2 | 1/2008 | Ferderer | 439/701 |
| 9,577,365 | B1 * | 2/2017 | Herbrechtsmeier | H01R 13/518 |
| 2012/0289098 | A1 * | 11/2012 | Stjepanovic | H01R 4/4818 439/822 |

FOREIGN PATENT DOCUMENTS

| | | | | |
|---|---|---|---|---|
| CN | 202084755 | | 12/2011 | H01R 13/514 |
| CN | 202084755 U | * | 12/2011 | H01R 13/518 |
| CN | 202352910 | | 7/2012 | H01R 13/518 |
| DE | 19707120 | | 6/1998 | H01R 13/514 |
| DE | 202012103360 | | 1/2013 | H01R 13/514 |
| DE | 202013103611 | | 9/2013 | H01R 13/514 |
| EP | 0860906 | | 8/1998 | H01R 13/514 |
| KR | 20040078052 | | 9/2004 | H01R 12/71 |
| NL | 6617175 | | 6/1967 | H01R 13/04 |
| RU | 71482 | | 3/2008 | H02B 1/00 |

OTHER PUBLICATIONS

Russian Decision to Grant (w/translation) issued in application No. 2017107180/07, dated Apr. 26, 2018 (16 pgs).
International Search Report and Written Opinion (w/translation) issued in application No. PCT/EP2015/067221, dated Oct. 13, 2015 (19 pgs).
International Preliminary Report on Patentability (w/translation) issued in application No. PCT/EP2015/067221, dated Feb. 14, 2017 (13 pgs).
HARTING Industrie-Steckverbinder Han® catalog, 2016, relevant pages (24 pgs).
Chinese Office Action (w/translation) issued in application No. 201580054305.3, dated Aug. 31, 2018 (11 pgs).
Korean Office Action (w/translation) issued in application No. 10-2017-7006085, dated Nov. 26, 2018 (6 pgs).

* cited by examiner

HOLDING FRAME AND METHOD FOR PRODUCING SAME

BACKGROUND OF THE INVENTION

The invention relates to a holding frame for holding plug connector modules and for installing in plug connector casings or for screwing onto wall surfaces, wherein the plug connector modules are inserted into the holding frame, and holding means on the plug connector modules cooperate with recesses which are provided on opposite wall parts (side parts) of the holding frame. The invention also relates to an appropriate production method.

Holding frames of this kind are used for holding plug connector modules, the holding frame being populated with different plug connector modules and subsequently inserted into a plug connector casing and fastened thereto. The holding frame must be mechanically stable in order to withstand the insertion and withdrawal forces that arise when forming or separating the plug connection.

A substantially rectangular holding frame provided with side walls extending at right angles to the mounting plane is known from the document entitled "Schwere Steckverbinder, Han-Modular, 16 3" published by the firm of HARTING Elektronik GmbH.

The plug connector modules are provided with detent hooks which snap into the side walls when the plug connector modules are inserted into the holding frame, and are thus held securely in the latter.

Only with special removal tools is it then possible to replace the plug connector modules. i.e. to remove or release them.

A development of that solution is described in DE 197 07 120 C1 and EP 0 860 906 A2, in which a holding frame according to the preamble of claim 1 is disclosed. The object of the invention disclosed in DE 197 07 120 C1 and EP 0 860 906 A2 is that the plug connector modules can be installed and dismounted in the simplest possible manner. However, the intention is nevertheless to ensure that the holding frame has a high level of mechanical stability in order to withstand the insertion and withdrawal forces that arise when forming or separating the plug connection.

The holding frame described therein consists of two frame halves which are connected to each other by hinges and have fastening ends provided with fastening screws. The hinges are provided at the fastening ends of the holding frame, and the frame halves are able to pivot transversely to the side parts of the holding frame. To form the hinges, moulded portions which engage in matching recesses are provided in each case at the fastening ends of the holding frame or of the side parts.

When producing such a holding frame, these moulded portions are pushed into the recesses by moving the side parts laterally, and the side parts are subsequently pivotable (rotatable) about the longitudinal axis. After the side parts have been joined, limiting posts which are embodied in the form of earthing contacts in accordance with DE 197 07 120 C1 and EP 0 860 906 A2 are inserted into the fastening ends. The limiting posts are provided at the respective outer ends of the side parts, so the hinges are between the limiting posts. This arrangement of the limiting posts prevents any axial displacement of the side parts.

However, inserting the limiting posts is an additional step that makes the overall production of the holding frame more complicated and therefore more cost-intensive, but simply dispensing with inserting the limiting posts results in the holding frame no longer being secured against axial displacement of the side parts. Such displacement could therefore occur in use (and especially during initial installation), with the result that the holding frame falls apart into its frame halves. This would compromise the safe handling of the holding frame.

If, as described in DE 197 07 120 C1 and EP 0 860 906 A2, the limiting posts additionally function as earthing contacts, this dual function also limits the range of possible positions where such an earthing contact can be provided.

SUMMARY OF THE INVENTION

The object of the invention is to develop the holding frame known from the prior art in a way that allows simplified and/or less cost-intensive production with additional flexibility regarding the positioning or omission of earthing contacts, without compromising the safe handling of the holding frame.

To achieve this object, a holding frame for holding plug connector modules and for installing in plug connection casings or for screwing onto wall surfaces is proposed, wherein the plug connector modules are insertable into the holding frame and holding means on the plug connector modules cooperate with recesses provided on opposite side parts of the holding frame, wherein the recesses are formed as laterally closed openings in the side parts of the holding frame, wherein the holding frame comprises two halves articulatedly connected to each other, wherein the holding frame separates along a line parallel to the side parts of the holding frame, wherein hinges are arranged in fastening ends of the holding frame in such a way that when the holding frame is screwed onto a fastening surface the frame parts are oriented in such a way that the side parts of the holding frame are oriented at right angles to the fastening surface and one or more inserted plug connector modules are connected interlockingly to the holding frame by means of the holding means, and wherein the fastening ends each have a fastening section extending in the screwed-on state parallel to the fastening surface, wherein one frame half has a projection in at least one fastening section, which protrudes in the direction of the other frame half and which engages with a recess in the fastening section of the other frame half in such a way that any lateral displacement of the side parts is prevented.

Another aspect of the invention consists in a method for producing a holding frame according to the invention, namely in a method for producing a holding frame for holding plug connector modules and for installing in plug connection casings or for screwing onto wall surfaces, wherein the plug connector modules are insertable into the holding frame and holding means on the plug connector modules cooperate with recesses provided on opposite side parts of the holding frame, wherein the holding frame comprises two halves articulatedly connected to each other, wherein the holding frame separates along a line parallel to the side parts of the frame, said method comprising the steps of: producing frame halves in such a way that the recesses are formed as laterally closed openings in the side parts of the holding frame, and joining together the frame halves, wherein hinges are arranged after said joining in fastening ends of the holding frame in such a way that when the holding frame is screwed onto a fastening surface the frame parts are oriented in such a way that the side parts of the holding frame are oriented at right angles to the fastening surface and one or more inserted plug connector modules are connected interlockingly to the holding frame by means of the holding means, wherein the fastening ends each have a fastening section extending in the screwed-on state parallel to the fastening surface, wherein the production of the frame halves is performed in such a way that one frame half has a projection in at least one fastening section, which protrudes in the direction of the other frame half and which engages with a recess in the fastening section of the other frame half in such a way that in the joined state any lateral displacement of the side parts is prevented, wherein joining includes elastic deformation of at least one frame half to arrange the hinges.

One aspect that the present invention has in common with the teaching of DE 197 07 120 C1 and EP 0 860 906 A2 is that the plug connector modules can be assembled and disassembled without special tools being needed. It is also the case with the invention that, after installing the holding frame in a plug connector casing or on a wall surface, the plug connector modules are secured interlockingly in the holding frame, thus providing a high level of mechanical stability on the whole for absorbing and transferring the insertion and withdrawal forces that arise when forming or separating the plug connection.

BRIEF DESCRIPTION OF THE DRAWINGS

An embodiment of the invention is shown in the enclosed drawings and is described in further detail below. In the drawings.

DETAILED DESCRIPTION OF THE INVENTION

Figure 1A:
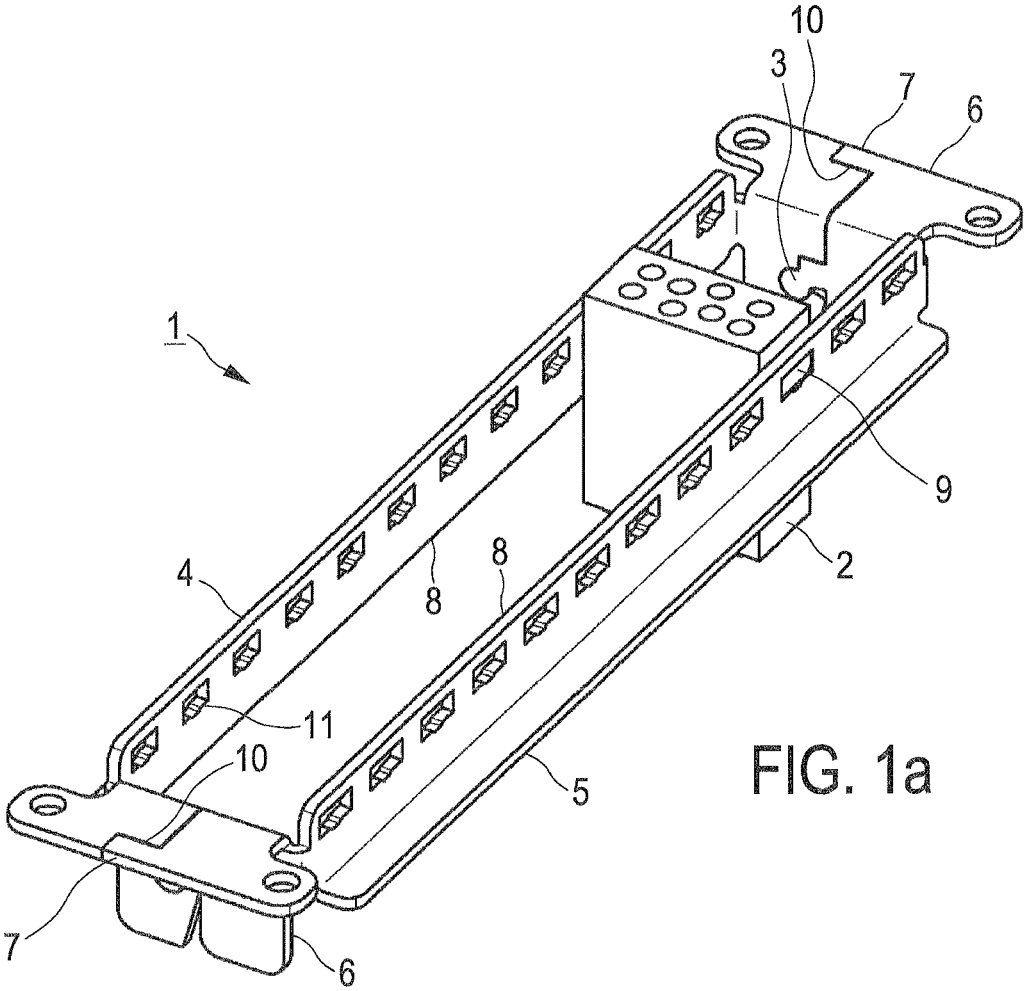
FIGS. 1*a* and 1*b* show views of a closed holding frame in accordance with an embodiment of the invention.
Figure 1B:
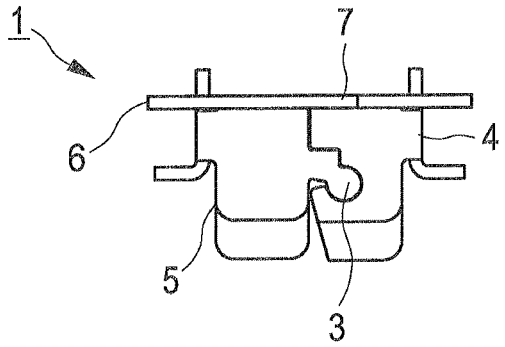
Figure 2A:
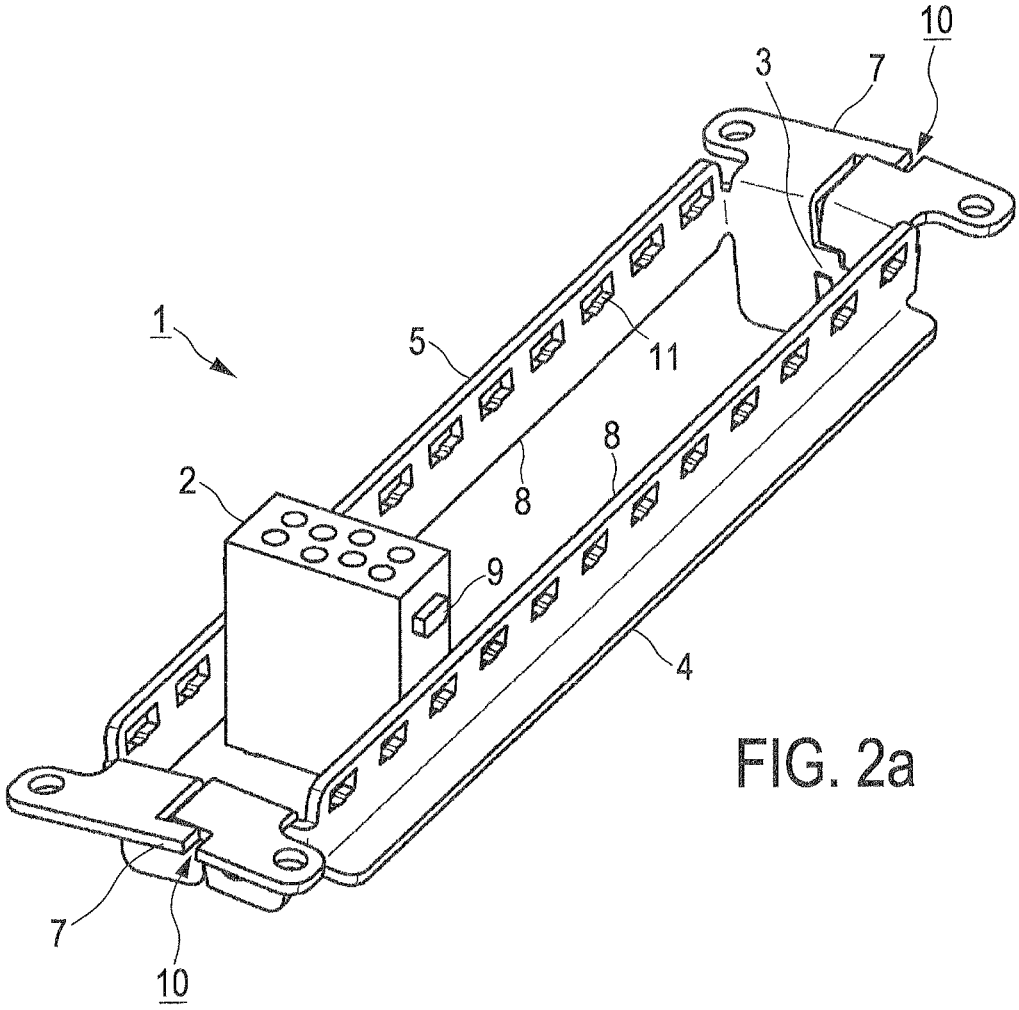
FIGS. 2*a* and 2*b* show views of an open holding frame in accordance with an embodiment of the invention and FIG. 3 shows a schematic flow diagram of an embodiment of a method for producing a holding frame according to the invention.
Figure 2B:
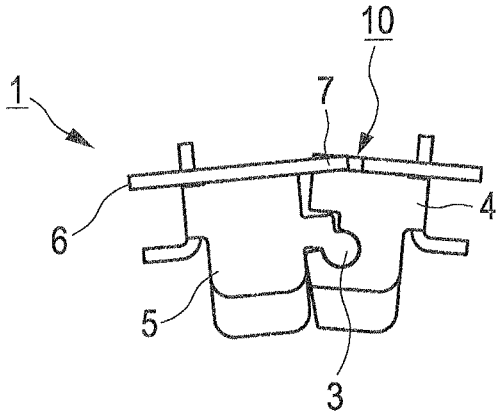

In FIGS. 1*a*, 1*b*, 2*a* and 2*b*, a holding frame 1 for plug connector modules 2 is shown, the holding frame being open in FIGS. 2*a* and 2*b* and closed in FIGS. 1*a* and 1*b*.

Holding frame 1 is provided for installation, after insertion of plug connector modules 2, in a plug connector casing (see DE 197 07 120 C1 and EP 0 860 906 A2) or for fastening through a recess in an attachment surface or mounting wall.

Holding frame 1 consists of two frame halves 4, 5 connected via hinges 3 and having fastening ends 6 which can be provided with fastening screws (not shown), and side parts 8. Hinges 3 are provided at the fastening ends 6 of holding frame 1, and frame halves 4, 5 are able to pivot transversely to side parts 8 of holding frame 1 (as can be seen by comparing FIGS. 1*a*, 1*b* and 2*a*, 2*b*). To form hinges 3, moulded portions which engage in matching recesses are provided in each case at the fastening ends 6 of holding frame 1. After the moulded portion are inserted into the recesses, the side parts can be pivoted (rotatably) about the longitudinal axis.

Plug connector modules 2 are provided with projecting, approximately rectangular holding means 9 and may additionally have resilient detent hooks (not shown). Recesses 11, in the form of openings which are bounded on all sides, are provided in the side parts 8 of frame halves 4, 5, and holding means 9 are received in said recesses when plug connector modules 2 are inserted into holding frame 1.

To insert plug connector modules 2, holding frame 1 is unfolded, i.e. opened, frame halves 4, 5 being unfolded about hinges 3 to such an extent that plug connector modules 2 can be inserted.

For preliminary fixing of plug connector module 2, the detent hooks that may be provided initially engage, on insertion, under the lower edges of side parts 8 of frame halves 4, 5.

Frame halves 4, 5 are subsequently folded together, i.e. holding frame 1 is closed, with holding means 9 entering recesses 11 in the process and producing secure, interlocking retention of plug connector modules 2 in holding frame 1.

Fastening ends 6 each have a fastening section extending in the screwed-on state (see FIGS. 1*a* and 1*b*) parallel to fastening surface (not shown). In the case of FIG. 1*b*, the plane of extension of said fastening section extends horizontally and at right angles to the plane of the drawing.

In the region of the fastening section, there are projections 7 and recesses 10 in frame halves 5, 4, which are in engagement with each other when the holding frame is in the assembled state.

In the embodiment shown, projections 7 of frame half 5 extend in the plane of extension in the direction of frame half 4, or more precisely into the recesses 10 in frame half 4. Projections 7 and recesses 10 are each arranged at the outermost end of the fastening sections (in the longitudinal direction). Due to projections 7 locking the opposite frame half 4 in the plane of extension, in some measure, relative displacement along the longitudinal axis is thus prevented for frame half 4, 5 and hence also for side parts 8. In other words, the upper projection 7 in the view shown in FIG. 1*a* blocks any movement slantingly towards the top right (in the view shown), by engagement with the respective recess 10, whereas the lower projection 7 prevents any movement slantingly towards the bottom left (in the view shown), by engagement with the respective recess 10.

In an alternative or supplementary variant, the recess may also be slot-shaped, so engagement of even a single projection will prevent any lateral displacement of side parts 8 in either direction. Slot-shaped should be understood in such a way in this context that the recess has at least two opposite edges against which the projection abuts, thus preventing any lateral displacement. So this variant is not limited to just a slot as recess, since in the shape of mushrooms, semicircles, triangles, etc. must also be considered slot-shaped.

When the frame halves are suitably dimensioned and designed, it is also possible for identical frame halves to be joined together to form one holding frame, each frame half then having one projection and one recess (at opposite ends).

Projection 7 is preferably so long, as in this embodiment, that engagement is not terminated even when holding frame 1 is folded out (see FIG. 2*b*), so that the prevention of any lateral movement is also maintained in the folded out state. This prevent the holding frame from being inadvertently split into its constituent halves.

Figure 3:
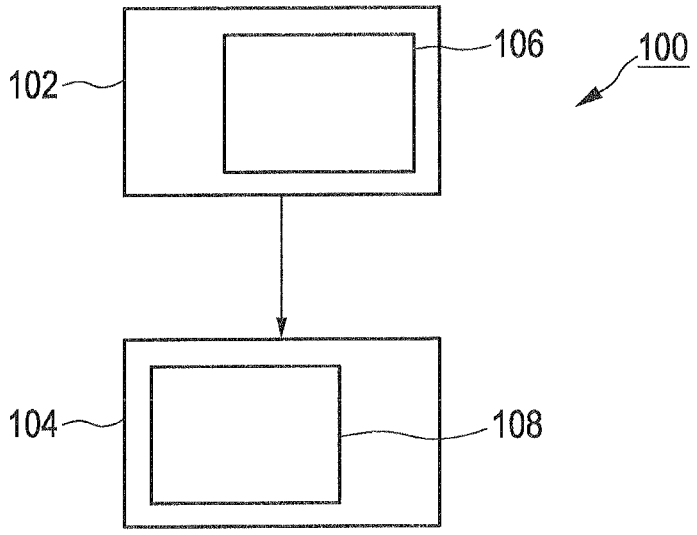

FIG. 3 shows a schematic flow diagram of a method according to the invention for producing a holding frame according to the invention.

Method 100 comprises the steps of producing 102 the frame halves and joining 104 the frame halves.

The holding frame comprises two halves articulatedly connected to each other, wherein the holding frame separates along a line parallel to the side parts of the frame.

The frame halves are firstly produced in step 102, namely in such a way that the recesses are formed as laterally closed openings in the side parts of the holding frame. In one preferred embodiment, the openings are formed by sheet metal forming (e.g. punching, cutting, lasing, etc.) as part of a process for producing the frame halves by punching and bending.

In step 104, the frame halves are joined together, wherein hinges are arranged, after joining, in fastening ends of the holding frame in such a way that when the holding frame is screwed onto a fastening surface the frame parts are oriented in such a way that the side parts of the holding frame are oriented at right angles to the fastening surface and one or more inserted plug connector modules are connected interlockingly to the holding frame by means of the holding means.

As discussed above, the fastening ends each have a fastening section extending in the screwed-on state parallel to the fastening surface.

Production 102 of the frame halves includes, as substep 106, providing a projection in at least one of the frame halves in at least one of its fastening sections, which in the joined state protrudes in the direction of the other frame half and engages with a recess (which is likewise produced in substep 106) in the fastening section of the other frame half, in such a way that in the joined state any lateral displacement of the side parts is prevented.

If the step of producing 102 is carried out by punching and bending, the projection and the recess can each be provided in a simple manner by appropriate forms of sheet metal forming (e.g. punching, cutting, lasing, etc.).

Joining 104 includes elastic deformation 108 of at least one frame half to arrange the hinges.

In the example shown in FIG. 1*a*, the frame halves are joined by shortening frame half 4 in such a way, by elastically deforming side wall 8 by applying tension, that, when relaxing the tension after positioning the frame halves accordingly in relation to each other, the moulded portions slip into the recesses to form hinges 3.

An alternative to shortening the frame half consists in the elastic deformation being carried out in the edge region between fastening end 6 and side wall 8, for example by reducing an edge angle at an edge of fastening end 6 and increasing an edge angle at an edge of fastening end 6 of the opposite frame half 5.

These deformations can also be combined with each other.

In the context of the preferred embodiment, the frame halves of the holding frame are produced by punching and bending and by sheet metal forming (e.g. by punching, cutting, lasing, etc.) from sheet metal. However, other production methods and other materials (e.g. plastics) are likewise possible. It should be noted that the two halves of the holding frame can also be produced using different production methods and/or different materials (e.g. one frame half made of plastic and one frame half made of metal). The choice of material is limited only by the properties that are needed for use as a holding frame, with a further requirement for the production method according to the invention being that at least the one frame half to be deformed has sufficient elasticity by design and/or by selecting suitable materials.

With regard to production of the holding frame according to the invention, the invention also includes, for example, a method having the steps of producing two frame halves, elastic deformation of at least one of the frame halves (for example by shortening one frame half by applying tension or by reducing or increasing an edge angle) and forming an articulated connection between to frame halves by relaxing the elastic deformation.

The invention claimed is:

1. A holding frame for holding plug connector modules and for installing in a plug connector casing or for screwing onto wall surfaces, wherein the plug connector modules are configured to be inserted into the holding frame and the plug connector modules have a holding arrangement configured to cooperate with recesses provided on opposite side parts of the holding frame, characterized in that the recesses are formed as laterally closed openings in the side parts of the holding frame, wherein the holding frame comprises two halves articulatedly connected to each other, wherein the holding frame separates along a line parallel to the side parts of the frame, wherein hinges are arranged in fastening ends of the holding frame in such a way that when the holding frame is screwed onto a fastening surface the frame parts are oriented in such a way that the side parts of the holding frame are oriented at right angles to the fastening surface and one or more inserted plug connector modules are connected interlockingly to the holding frame by the holding arrangement, and wherein the fastening ends each have a fastening section extending in the screwed-on state parallel to the fastening surface, wherein one frame half has a projection in at least one fastening section, which protrudes in the direction of the other frame half and which is configured to engage with a recess in the fastening section of the other frame half to prevent any lateral displacement of the side parts.

2. The holding frame according to claim 1, wherein the one frame half has a projection in each of the two fastening sections, configured to engage with a respective recess in the fastening section of the other frame half, wherein the projection and recess pairs are configured to prevent any counteracting lateral displacement of the side parts relative to each other.

3. The holding frame according to claim 2, wherein the projections and recesses are each located at the ends of the fastening sections in the longitudinal direction.

4. The holding frame according to claim 2, wherein the recess is slot-shaped and that the engagement of the projection is configured to prevent any lateral displacement of the side parts in both directions.

5. The holding frame according to claim 1, wherein the recess is slot-shaped and that the engagement of the projection is configured to prevent any lateral displacement of the side parts in both directions.

6. A method for producing a holding frame for holding plug connector modules and for installing in a plug connector casing or for screwing onto wall surfaces, wherein the plug connector modules are insertable into the holding frame and a holding arrangement on the plug connector modules cooperates with recesses provided on opposite side parts of the holding frame, characterized in that the holding frame comprises two halves articulatedly connected to each other, wherein the holding frame separates along a line parallel to the side parts of the frame, said method comprising the steps of:

forming the frame halves with recesses formed as laterally closed openings in the side parts of the holding frame, and joining together the frame halves, wherein hinges are arranged after said joining in fastening ends of the holding frame in such a way that when the holding frame is screwed onto a fastening surface the frame parts are oriented in such a way that the side parts of the holding frame are oriented at right angles to the fastening surface and one or more inserted plug connector modules are connected interlockingly to the holding frame by the holding arrangement, wherein the fastening ends each have a fastening section extending in the screwed-on state parallel to the fastening surface, wherein the frame halves are formed such that one frame half has a projection in at least one fastening section, which protrudes in the direction of the other frame half and which engages with a recess in the fastening section of the other frame half such that in the joined state any lateral displacement of the side parts is prevented, and wherein joining includes elastic deformation of at least one frame half to arrange the hinges.

7. The method according to claim 6, wherein the frame halves are formed by punching and bending.

* * * * *